United States Patent [19]

Bond

[11] 4,192,029

[45] Mar. 11, 1980

[54] HEAD AND NECK SUPPORTIVE DEVICE FOR HEMISIDE RECLINING PERSONS

[76] Inventor: Helen I. Bond, 19416 NE. 122nd Ave., Battleground, Wash. 98604

[21] Appl. No.: 951,445

[22] Filed: Oct. 16, 1978

[51] Int. Cl.[2] ..... A47G 9/00

[52] U.S. Cl. ..... 5/441; 5/442

[58] Field of Search ..... 5/327 R, 327 B, 337, 5/338, 341

[56] References Cited

U.S. PATENT DOCUMENTS

| | | | |
|---|---|---|---|
| 2,577,595 | 12/1951 | Tobias | 5/338 |
| 2,782,427 | 2/1957 | Ericson | 5/338 |
| 3,883,906 | 5/1975 | Sumpter | 5/338 |
| 4,074,376 | 2/1978 | Bond | 5/338 |
| 4,118,813 | 10/1978 | Armstrong | 5/338 |

*Primary Examiner*—Casmir A. Nunberg
*Attorney, Agent, or Firm*—George R. Nimmer

[57] ABSTRACT

Disclosed are plural segments cushiony pillows, preferably in the form of three hingedly connected independent cushiony segments, to comfortably nestle, and yet firmly support, the head and the neck of hemiside reclining persons. With the preferred three pillow segments being employed, the medially positioned primary segment is larger than the flanking secondary and tertiary segments, the secondary segment being larger than the tertiary segment. The plural segments head and neck cushiony supportive device has numerous utilitarian advantages including: for geriatric care, for the prevention of snoring, and generally speaking for the promotion of good hemiside reclining posture thus enhancing comfortable sleeping and resting.

13 Claims, 7 Drawing Figures

FIG. 1
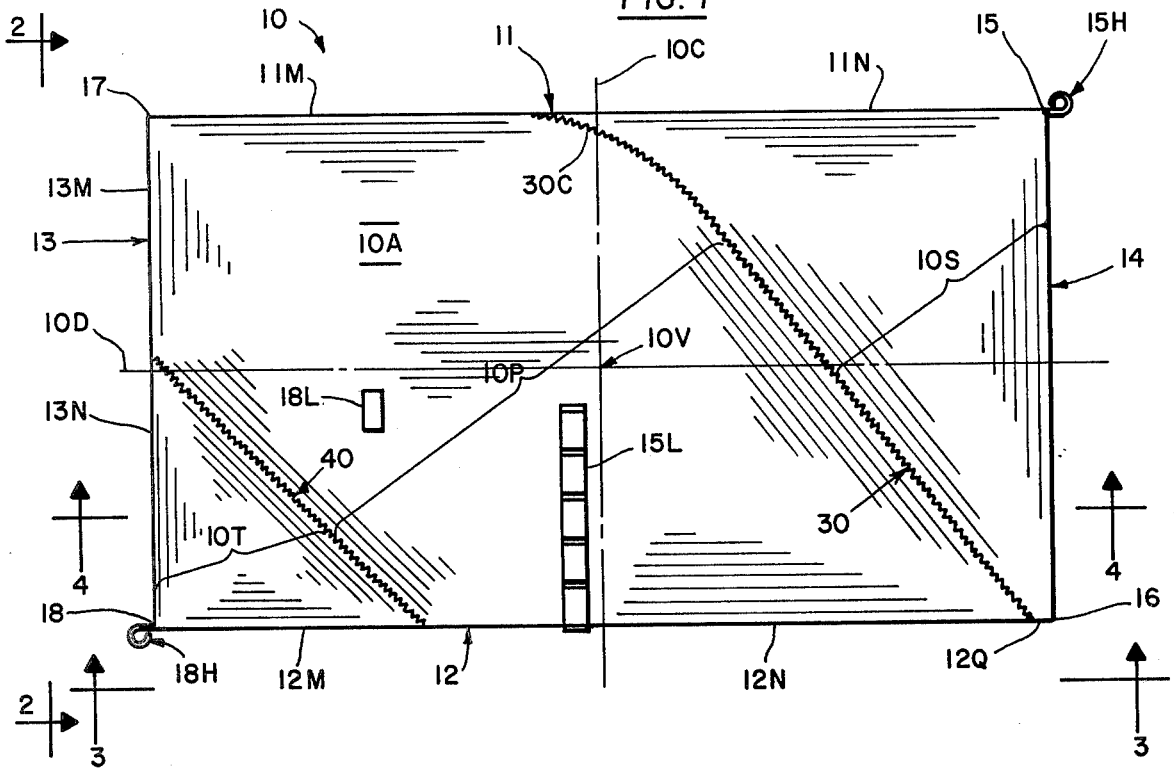
FIG. 2
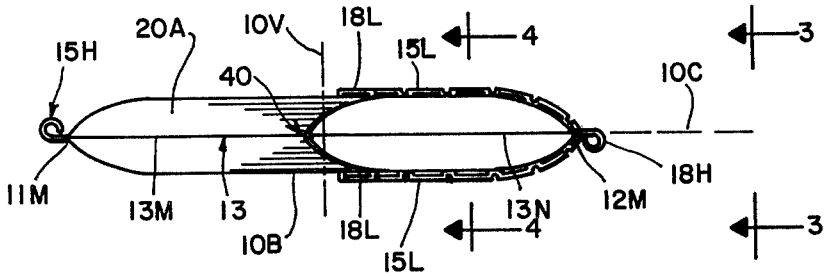
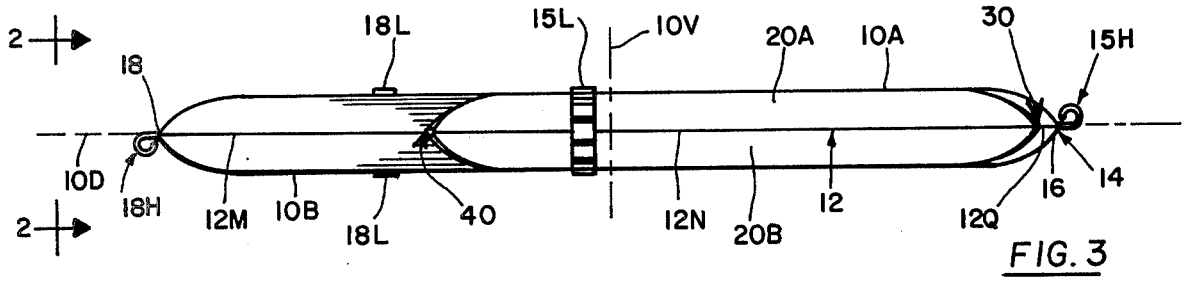
FIG. 3
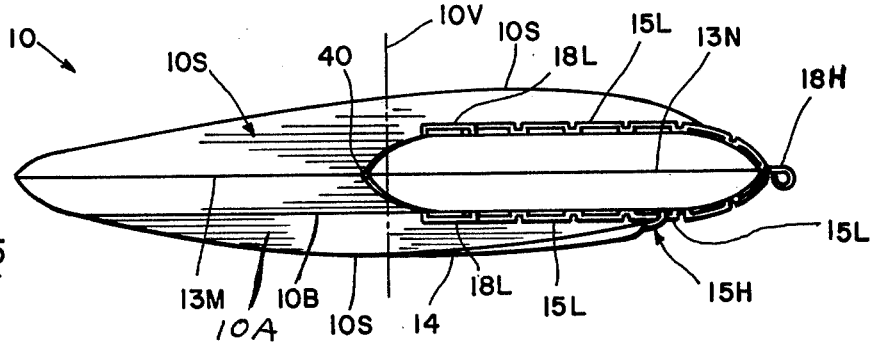
FIG. 5

FIG. 4
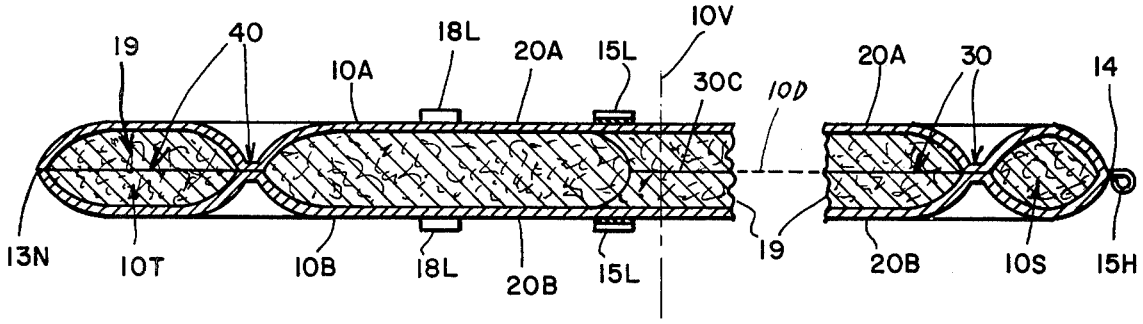
FIG. 6
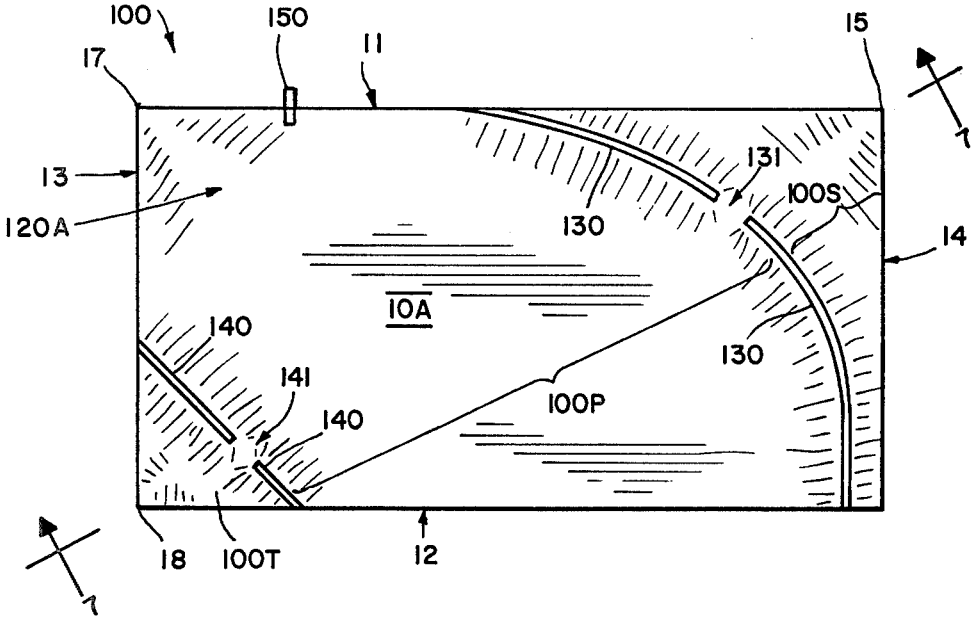
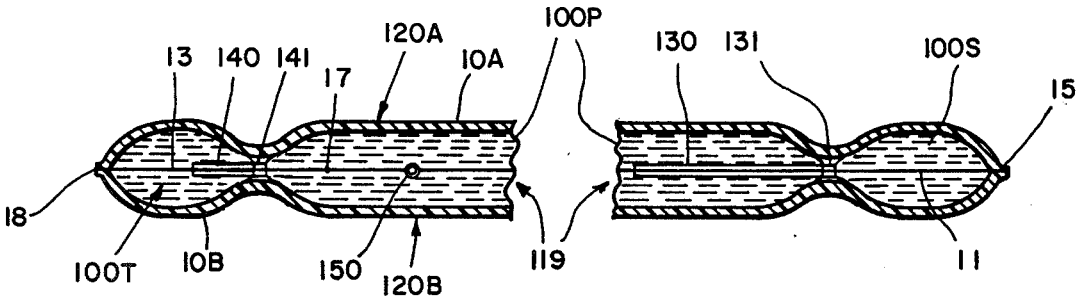
FIG. 7

HEAD AND NECK SUPPORTIVE DEVICE FOR HEMISIDE RECLINING PERSONS

There are three basic reclining positions, namely, prone, supine, and hemiside, the hemiside being when a person rests upon one of his upper-arms and a single temple and facial cheek downward. It is well known that the hemiside position is better than prone or supine for certain maladies. For example, the hemiside position is known to reduce snoring during sleep, to enhance the drainage of nasal and sinus fluids accompanying infections and congestion, to lessen the likelihood of vomit strangulation, to relieve inimical pressure upon patients suffering from anterior or posterior traumatic injury, and to faciliate geriatrics' breathing (provided the upward shoulder is not allowed to hunch forwardly) thereby reducing the likelihood of sleep apnea.

Pillow-like devices for stably securing or supporting the head, neck, and a shoulder of hemiside reclining persons are taught in the prior art including, inter alia, U.S. Pat. Nos. 2,167,622(Bentivoglio-8/1/1939), 2,782,427(Ericson-2/26/1957), 3,694,831(Treace-10/3/1972), and 3,938,205(Spann-2/17/1976). However, certain prior art structures do not reliably support the user in truly hemiside reclining position, others are of a cumbersome construction, many do not provide the cradling nestling comfort required by geriatric patients, still others do not satisfactorily yet gently resist the person's tendency to twist, roll, or hunch forwardly upon the bed reclining surface, and others do not reliably comfortably maintain the person's head upon one only of its symmetrical sides for required therapeutic purposes.

It is accordingly the general object of the present invention to provide head, neck, and shoulder supportive devices that will reliably and comfortably maintain the user in hemiside reclining position and including too reasonable assurance that the person's head will stably rest upon but one facial side downward while vertabrae of the neck and upper back rest in alignment including rearward support for the upward shoulder thereby affording proper deep-breathing posture, therapeutic and other beneficial results to the user of the device.

With the above and other objects and advantages in view, which will become more apparent as this description proceeds, the head and neck supportive device of the present invention generally comprises, a pillow-like structure including a pair of opposed external broad surfaces merging at top-edge, bottom-edge, front-edge, and rear-edge; hinge-like frontal and rearward boundaries for the pillow primary-segment along oppositely flanking secondary and tertiary segments for the pillow-like supportive device, the first-hinge along the secondary-segment being lengthier than the second-hinge whereby the secondary-segment is larger than the tertiary-segment though smaller than the primary-segment; and when the supportive device is in use, the secondary-segment is located beneath the primary-segment such that the elongate boundary between the primary-segment and secondary-segment is inclinded upwardly and rearwardly from the pillow horizontal top-edge to nestle and firmly support the posterior of the hemiside reclining person's head and neck and preferably extending as firm support to the recliner's upwardly extending shoulder.

In the drawing, wherein like characters refer to like parts in the several views, and in which:

FIG. 1 is a top plan view of a representative embodiment of the head and neck supportive device of the present invention;

FIG. 2 is a front side elevational view of the FIG. 1 embodiment;

FIG. 3 is a bottom side elevational view of the FIG. 1 embodiment;

FIG. 4 is a sectional elevational view taken along lines 4—4 of FIGS. 1 and 2;

FIG. 5 is a front side elevational view like FIG. 2 but with phantom lines showing the secondary-segment positioned beneath the primary-segment under a typical use condition;

FIG. 6 is a plan view similar to FIG. 1 of an alternate embodiment head and neck supportive device; and FIG. 7 is a sectional elevational view taken along line 7—7 of FIG. 6.

Embodiments 10 (FIGS. 1–4) and 100 (FIGS. 6–7) of the head and neck supportive device are pillow-like structures including a pair of opposed external surfaces 10 A and 10B (intersected by vertical axis 10V) merging at longitudinally extending top-edge 11 and bottom-edge 12 and at transversely extending front-edge 13 and rear-edge 14. The edges 11 and 12 (which are preferably parallel to longitudinal horizontal axis 10D and of substantially like lengths ) are lengthier than edges 13 and 14 (which are preferably parallel to transverse horizontal axis 10C and of substantially like lengths), such that the dimensional ratio of top-edge 11 to rear-edge 14 is within the range of $1\frac{1}{4}$ to $1\frac{3}{4}$. For embodiment 10, surfaces 10A and 10B are provided of air-pervious fabric sheets 20A and 20B which are preferably of rectangular shape, the pillow cushioning means between sheets 20A and 20B being fluffy solid material 19. In embodiment 100, surfaces 10A and 10B are provided by fluid-impervious sheets 120A and 120B, whereby gas or liquid 119 might be employed for the cushioning means. Even further embodiments might employ self-sustaining cushioning means which might itself provide the external surfaces 10A and 10B and the required areal and volumetric relationships among the primary, the secondary, and the tertiary cushioned segments.

Supportive device embodiments 10, 100, etc.. are divided into three attached and distinct segments including a volumetrically and areally preponderant primary-segment (10P, 100P) oppositely flanked by a smaller secondary-segment (10S, 100S) and an even smaller tertiary-segment (10T, 100T). When the head and neck supportive devices herein are being used by hemiside reclining persons, and as alluded to in FIG. 5, portions of the secondary-segment (10S, 100S) including the pillow top-rear corner 15 is located beneath the primary or headrest-segment (10P, 100P). Thus, the juncture (30, 130) between the primary-segment and the secondary-segment inclines upwardly and rearwardly of lower surface 10B from horizontal top-edge 11 for nestling and firmly supporting the posterior of the hemiside reclining person's head and neck. Also, portions of the tertiary-segment including the pillow bottom-front corner 18 is locatable beneath the headrest-segment (10P, 100P) and forwardly of the similary undertucked secondary-segment (10S, 100S). An emmissis basin (not shown) might be positioned along the juncture 40, 140, when the device is in use. As will be pointed out, the preferred means for locating the secondary and tertiary segments beneath the primary-segment includes bi-directional hinged connections (30, 40, 130, 140) for the secondary and tertiary segments to the primary-segment. In this way, a single supportive device e.g. 10, 100, will permit the hemiside reclining person to rest upon either the leftward or the rightward body side.

Turning now to FIGS. 1–4 which depict representative embodiment 10. Two rectangular flexible fabric sheets 20A and 20B are peripherally connected along the four pillow edges 11–14, a suitable solid cushioning means 19 (such as feathers, wadding, or comminuted flowable solid) being enclosed within sheets 20A and 20B. The bi-directional hinge means 30 and 40 can take the form of elongate connections, such as stiching, adhesive, etc., between sheets 20A and 20B, the herein stitched first-hinge 30 being lengthier than second-hinge 40. First-hinge 30 and second-hinge 40 are respectively non-parallel to: rear-edge 14, front-edge 13, top-edge 11, and bottom-edge 12. Thus, there are three cushioned (19) compartment-like segments including:

i. volumetrically and areally predominant primary-segment 10P defined by first-hinge 30, second-hinge 40, the major length 13M of front-edge 13, and substantial length proportions 11M and 12N of top-edge 11 and bottom-edge 12, respectively:

ii. medium size secondary-segment 10S defined by first-hinge 30, rear-edge 14, a substantial length proportion 11N of top-edge 11, and a very minor length 12Q of bottom-edge 12; and iii. small size tertiary-segment 10T defined by second-hinge 40, minor length proportion 12M of bottom-edge 12, and minor length proportion 13N of front-edge 13.

Cushioning means e.g. 19, is disposed on both sides of the respective elongate hinge-like joinders e.g. stitched connections 30 and 40, between sheets 20A and 20B. Preferably, the first-hinge 30 is at least twice the length of secondary-hinge 40 whereby the tertiary segment 10T both volumetrically and in FIG. 1 plan area is less than one-half the volume and plan area of the secondary-segment 10S. The said lengthier first-hinge also ensures that the primary-segment 10P areally comprises at least three-fifths, and preferably substantially two-thirds, the device overall plan view area defined by perimeter 11-14. Preferably, the first-hinge is very gently curved with its convexity extending toward the top-rear corner 15, and at its herein curved terminus 30C strategically intersects top-edge 11 whereby the dimensional ratio 11M/ 11N is within the range of 5/12 to 7/12.

Desireably, there are means for removably anchoring the the top-rear corner 15 and bottom-front corner 18 to one or preferably to either one of the broad surfaces 10A or 10B. For example, top-rear corner 15 might carry a hook 15H, string tie, etc., and bottom-front corner 18 might analagously carry a hook 18H, string tie, etc., Hook 18H (or other equivalent fastener) might be removably secured to the respective surfaces 10A or 10B through uni-loops 18L carried at these surfaces. A transversely extending multi-looped strip 15L, preferably parallel edges 13 and 14 and substatially midway therebetween, might be attached to the respective surfaces 10A and 10B and at bottom-edge 12. The user or attendant can select a suitable loop member 15L for removable engagement with hook 15H(or other equivalent fastener) to thereby empirically select the most comfortable degree of upward inclination for secondary-segment 10S at its elongate juncture 30, as alluded to in FIG. 5.

Head and neck supportive device embodiment 100 of FIGS. 6 and 7 differs from embodiment 10 primarily in that there are flexible sheets 120A and 120B of a resinous or other fluid-impervious structural material appropriate for containing gas, liquid, or other non-solid cushioning means 119. Sheets 120A and 120B are peripherally joined along edges 11-14 and include hinge-like joinders 130 and 140 analagous to joinders 30 and 40. Such elongate joinders 11–14, 130, and 140, might comprise adhesives or even heat-sealed welding if thermoplastic sheets 120A and 120B are employed. Preferably, each of the hinge-like connections 130 and 140 comprise apertures or gaps 131 and 141, respectively, so that a single fluid-introduction valve 150 will service the entire multi-compartments device 100. Moreover, such gaps 131 and 141 ensure equal pressure exerted by the fluid cushioning means within all three segments or compartments 100P, 100S, and 100T.

From the foregoing, the construction and utility of the head and neck supportive devices of the present invention will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. A head supportive device for hemiside reclining persons and comprising a pillow having hingedly associated independent cushiony segments, said head supportive device comprising:

A. said pillow having a pair of broad external surfaces including a first-surface and a second-surface, having a pair of longitudinally extending edges including a top-edge and a bottom-edge, and having a pair of transversely extending edges including a front-edge and a rear-edge which are shorter than the longitudinal edges; and B. bi-directional hinged connections for the pillow segments including a first-hinge and a second-hinge, the first-hinge being substantially lengthier than the second-hinge and each hinged connection being no-parallel to: the rear-edge, the front-edge, the top-edge, and the bottom-edge, said two hinged connections delineating the pillow into a primary-segment located medially of and oppositely flanked by a secondary-segment and a tertiary-segment, said cushiony segments being described as:

i. a primary-segment defined by the first-hinge, the second-hinge, and substantial proportions of the pillow top-edge and bottom-edge thereby peripherally defining a headrest-segment that in plan view provides the major proportion of the pillow overall plan view area:

ii. a secondary-segment peripherally defined by the first-hinge, the pillow rear-edge and its tip-rear corner, and a substantial portion of the pillow top-edge, said secondary-segment at the pillow top-rear corner by virtue of said bi-directional first-hinge being locatable at arbitrarily selected positions beneath the primary-segment, whereby when the person's head is resting upon the primary-segment and anteriorly facing the second-hinge the first-hinge is inclined upwardly and rearwardly from the pillow top-edge; and iii. a tertiary-segment peripherally defined by the second-hinge and substantial lengths of the pillow front-edge and bottom-edge, said tertiary-segment by virtue of the second-hinge being locatable beneath the primary-segment and in plan view providing substantially less than the area of the secondary-segment.

2. The head supportive device of claim 1 wherein the first-hinge is at least twice the length of the second-hinge; wherein the primary-segment in plan view provides at least three-fifths the pillow overall plan view area; and wherein the tertiary-segment in plan view areally provides less than one-half that of the secondary-segment.

3. The head supportive device of claim 2 wherein the primary-segment in plan view provides at least two-thirds the pillow overall plan view area; and wherein the first-hinge is gently curved with convexity extending toward the pillow top-rear corner.

4. The head-supportive device of claim 1 wherein the cushiony pillow comprises a pair of opposed broad sheets including a first-sheet and a second-sheet respectively providing the said plan view first-surface and second-surface, there being suitable cushioning means between the broad sheets for cushioning also the respective segments; and wherein the bi-directional hinged connections comprise elongate joinders between the first-sheet and second-sheet whereby cushioning means are segregated thereby onto both sides of the first-hinge and second-hinge and which hinged connections and broad sheets define said segments as pillow interior compartments.

5. The head supportive device of claim 4 wherein the first-sheet and second-sheet are each rectangular and peripherally connected whereby the pillow top-edge and bottom-edge are parallel and the pillow front-edge and rear-edge are parallel.

6. The head supportive device of claim 5 wherein the cushioning means is a fluffly solid material.

7. The head supportive device of claim 5 wherein the cushioning means comprises at least one fluid-introduction valve through the pillow; and wherein the first-sheet and second-sheet are of fluid-impervious structural material.

8. The device of claim 7 wherein the first-sheet and the second-sheet are of air-impervious flexible thermoplastic material; and wherein the lengthy first-hinge and second-hinge are heat-sealed joinders between the first-sheet and second-sheet whereby along said hinged connections the first-sheet and second-sheet are in structurally continuous relationship, there being apertures for said joinders to maintain the air pressure constant from segment to segment.

9. The head supportive device of claim 5 wherein the primary-segment in plan view provides at least three-fifths the pillow overall plan view area; and wherein the tertiary-segment in plan view areally provides less than one-half that of the secondary-segment.

10. The device of claim 9 wherein the first-hinge is at least twice as lengthy as the second-hinge and is gently curved with convexity extending toward the pillow top-rear corner; and wherein the primary-segment volumetrically comprises at least two-thirds the pillow overall volume.

11. A head supportive device for hemiside reclining persons and comprising a cushioning pillow having independently cushiony segments, said pillow including a top-edge, a bottom-edge, a front-edge, and a rear-edge, and said pillow segments being described as:

A. a primary-segment located medically of and oppositely flanked by a secondary-segment and a tertiary-segment and extending along substantial lengths of the pillow top-edge and bottom-edge thereby volumetrically providing the major proportion of the pillow overall volume;

B. a secondary-segment peripherally defined by the pillow rear-edge and its top-rear corner and a substantial portion of the pillow top-edge, said secondary-segment including the pillow top-rear corner being located at an arbitrarily selected position beneath the primary-segment, whereby when the person's head is resting upon the primary-segment and anteriorly facing the tertiary-segment the elongate juncture between primary and secondary segments is inclined upwardly and rearwardly from the pillow top-edge; and C. a tertiary-segment peripherally defined by substantial lengths of the pillow front-edge and bottom-edge, said tertiary-segment being located beneath the primary-segment and volumetrically providing substantially less than the volume of the secondary-segment.

12. The device of claim 11 wherein the primary-segment provides at least three-fifths the pillow overall volume; and wherein the tertiary-segment volume is less than one-half the secondary-segment volume.

13. The head supportive device of claim 1 wherein there is removably securable anchoring means between the pillow top-rear corner and a plurality of selectable locations of the primary-segment.

* * * * *